United States Patent [19]

Parduhn

[11] Patent Number: 4,691,884

[45] Date of Patent: Sep. 8, 1987

[54] GOLF BAG SUPPORT

[76] Inventor: A. Philip Parduhn, 14501 Wilson Rd., Edmond, Okla. 73034

[21] Appl. No.: 803,484

[22] Filed: Dec. 2, 1985

[51] Int. Cl.[4] ..... A63B 55/04; A45F 3/44

[52] U.S. Cl. ..... 248/96; 248/156; 206/315.7

[58] Field of Search ..... 248/96, 156, 146; 206/315.7, 315.3

[56] References Cited

U.S. PATENT DOCUMENTS

| | | | |
|---|---|---|---|
| 1,808,724 | 6/1931 | Carlon | 248/96 |
| 1,926,184 | 7/1933 | Schwer | 248/96 |
| 2,024,484 | 12/1935 | Smith | 248/96 |
| 2,045,147 | 6/1936 | Johnson | 248/96 |
| 2,603,440 | 7/1952 | Vesconte et al. | 248/156 X |
| 2,633,317 | 3/1953 | Marsh | 248/96 |
| 2,661,175 | 12/1953 | Holder | 248/96 |
| 2,751,176 | 6/1956 | Mowry | 248/96 |
| 3,075,733 | 1/1963 | Kimmel | 248/96 |
| 3,342,444 | 9/1967 | Nelson | 248/156 X |
| 3,435,866 | 4/1969 | Cantwell | 248/96 |
| 3,570,795 | 3/1971 | Benzel | 248/96 |
| 3,593,766 | 7/1971 | Harmon et al. | 206/315.7 |
| 3,603,540 | 9/1971 | Gouge | 248/96 |
| 3,666,221 | 5/1972 | Schilz | 248/96 |
| 4,172,484 | 10/1979 | Henning | 248/96 X |
| 4,307,540 | 12/1981 | Reisner | 248/156 X |
| 4,483,506 | 11/1984 | Litwiller | 248/156 X |

FOREIGN PATENT DOCUMENTS

| | | | |
|---|---|---|---|
| 262586 | 7/1949 | France | 248/156 |

*Primary Examiner*—Richard J. Scanlan, Jr.
*Assistant Examiner*—Todd G. Williams
*Attorney, Agent, or Firm*—Dunlap, Codding & Peterson

[57] ABSTRACT

A golf bag support formed from a tubular housing which may be attached either to the interior or exterior of a golf bag. A spike section is received within the lower end of the housing, where it may be held in a normally retracted position. A wing section abuts the spike section and extends outside the housing through an open-ended longitudinal slot formed in the end of the housing. Supported by the wing section is a pedal section, which may be depressed to drive the wing and spike sections into the ground, in order to maintain the housing and attached golf bag in an upright position. When the wing and spike sections are removed from the ground a biasing spring anchored within the housing returns the spike section to its normally retracted position within the housing. A cross member is positioned within the housing between the biasing spring and the spike section to prevent depression of the pedal section beyond the lower end of the housing.

2 Claims, 13 Drawing Figures

GOLF BAG SUPPORT

FIELD OF THE INVENTION

The present invention relates generally to supports and more particularly to bag holders for golf bags.

SUMMARY OF THE INVENTION

The present invention comprises a golf bag support formed from a tubular housing having a first end and an open second end. Formed in the second end of the housing is at least one open-ended, unobstructed longitudinal slot. A ground-engaging element is formed from a spike section having a ground-engaging second end, the spike section movable between a retracted position within the housing and an extended position in which at least the second end of the spike section projects from the open second end of the housing. The ground-engaging element also includes a pedal section, positioned outside the housing, having a depressable first surface and an opposed second surface, and a ground-engagable wing section interengaging the spike section and second surface of the pedal section and extending through the slot in the housing when the spike section is in a retracted position. Biasing means, disposed intermediate the first end of the housing and the first end of the spike section, are provided for biasing the spike section toward a normally retracted position within the housing. Attachment means are provided for operatively securing the housing to a golf bag to be supported.

DETAILED DESCRIPTION OF THE PREFERRED EMBODIMENTS

Figure 1:
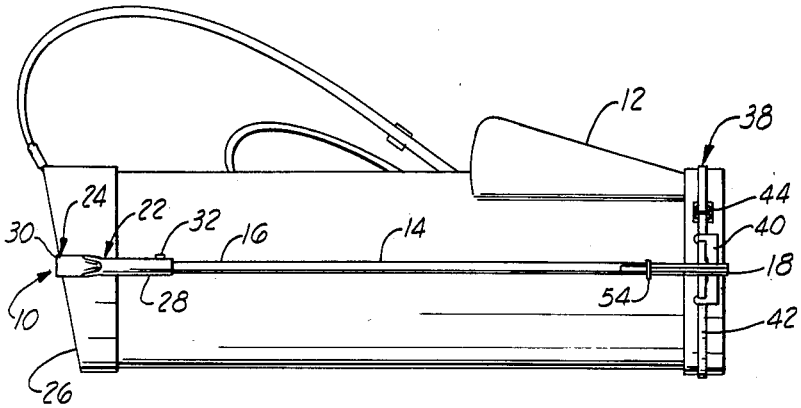
FIG. 1 is an elevational view of the golf bag support of the present invention, installed on the exterior of a golf bag, with the spike section shown in a retracted position.

The present invention comprises a golf bag support for holding a golf bag in an upright position on the ground, as is often required when a golf bag is in use on a golf course. In the embodiment shown in FIGS. 1, 2 and 3, the golf bag support 10 of the present invention is removably positionable adjacent the exterior of a golf bag 12. Comprising the golf bag support 10 is an elongate, tubular housing 14 formed from a strong, preferably lightweight material. The housing 14 is characterized by a first end 16 and an open second end 18.

Figure 2:
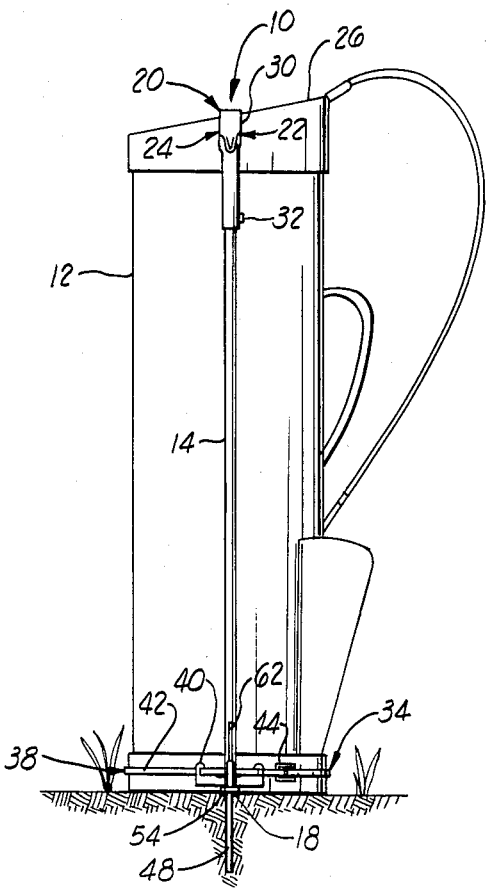
FIG. 2 is an elevational view of the golf bag support of the present invention, in use to support a golf bag in an upright position, with the spike section shown in an extended position.

Further comprising the golf bag support 10 is an attachment assembly 20 for operatively securing the housing 14 to the golf bag 12 to be supported, so that, as shown in FIG. 2, the housing 14 is perpendicular to the ground, and the open second end 18 is positioned adjacent the ground, when the golf bag 12 is standing upright. Comprising the attachment assembly 20 is an upper attachment assembly 22 for securing the housing 14 adjacent its first end 16 to the upper portion of a golf bag 12 to be supported.

Figure 3:
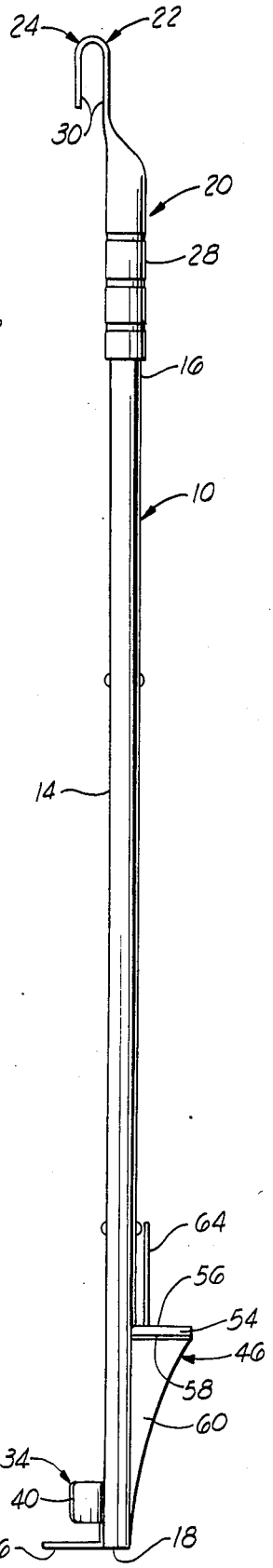
FIG. 3 is a side elevational view of the golf bag support of the present invention in which the spike section is shown in a retracted position. The strap and fastening device of the releasable strap assembly are not shown.

As best shown in FIG. 3, the upper attachment assembly 22 preferably comprises a hook assembly 24, supported on the housing 14 adjacent the first end 16 thereof, for engaging the housing 14 with the upper rim 26 of a golf bag 12 to be supported. The hook assembly 24, which preferably is formed from the same material as the housing 14, preferably comprises a tubular lower portion 28, which is telescopically and coaxially received over the housing 14 at its first end 16, and a rim-engaging hooked upper portion 30, which preferably is integral with the lower portion 28. As shown in FIGS. 1 and 2, the lower portion 28 is penetrated by a hole, and a retaining element 32, such as a set screw, is received therein. The retaining element 32 engages the housing 14 and releasably holds the hook assembly 24 in a fixed position relative to the housing 14. By releasing the retaining element 32, the hook assembly 24 may be axially repositioned relative to the housing 14, after which the retaining element 32 may be actuated to hold the hook assembly 24 in the selected position. Accordingly, the retaining element 32 and the cooperating lower portion 28 and housing 14 function as attachment spacing assembly for varying the distance between the upper attachment assembly 22 and the lower attachment assembly 34, which now will be described.

The attachment assembly 20 preferably further comprises a lower attachment assembly 34 for securing the housing 14 adjacent its second end 18 to the lower portion of a golf bag 12 to be supported. As best shown in FIG. 3, the lower attachment assembly 34 preferably comprises a base plate 36 which is engagable with the bottom of a golf bag 12 to be supported. The base plate 36 is preferably formed from the same material as the housing 14, and comprises a flat member supported by the housing 14 at a position immediately adjacent the second end 18 of the housing 14, in non-obstructing relationship to the second end 18. The base plate 36 is preferably oriented in a plane orthogonal to the axis of the housing 14, so that when the base plate 36 engages the underside of a golf bag 12, as shown in FIG. 2, the housing 14 will extend in substantially parallel relationship to the golf bag 12.

With continued reference to FIGS. 1, 2 and 3, the lower attachment assembly 34 preferably further comprises a releasable strap assembly 38 supported by the housing 14, for grippingly encircling the lower portion of a golf bag 12 to be supported. The releasable strap assembly 38 preferably comprises a bracket 40 having an curved surface adapted to fittingly engage a portion of the outer peripheral surface of a golf bag 12. The bracket 40 is supported by the housing 14, and more preferably is secured thereto by spot welds. In many instances, it may be preferred to form the bracket 40 and the base plate 36 as a single integral construction, as shown in FIG. 3.

As shown in FIGS. 1 and 2, the releasable strap assembly 38 preferably further comprises at least one strap 42, which preferably is formed from a strong, flexible material such as nylon. The bracket 40 preferably is provided with at least one, and more preferably two, eyes through which the strap 42 may be threaded. Supported on the strap 42 is a releasable fastening device 44, such as a buckle, for releasably securing the loose ends of the threaded strap 42, as required to secure the releasable strap assembly 38 in gripping, encircling engagement with the lower portion of the golf bag 12 to be supported, as shown in FIG. 1.

With reference to FIGS. 3 and 6–10, the golf bag support 10 of the present invention further includes a ground-engaging element 46. The ground-engaging element 46 comprises a spike section 48. The upper end portion 49, which remains in the housing 14 in all operating positions of the spike, is substantially circular in cross section and sized to slidingly fit in the housing 14. The upper end 50 of the spike is flat. The remaining portion of the body of the spike 48 is generally triangular in cross section and the lower end 52 is pointed to facilitate the forcing of the spike into the ground. The spike section 48, as a whole, is sized so as to be longitudinally receivable within the housing 14 at its open second end 18, so that it may be moved between a retracted position within the housing 14 and an extended position in which at least the second end 52 of the spike section 48, and more preferably substantially all of the spike section 48, projects from the open second end 18 of the housing 14.

Further comprising the ground-engaging element 46 is a pedal section 54 positioned outside the housing 14 and having a depressable first surface 56, adapted to be depressed by the foot of a user of the golf bag support 10 of the present invention, and an opposed second surface 58. The pedal section 54 preferably comprises a substantially planar member, formed from the same material as the spike section 48, and is oriented in substantially orthogonal relationship to the longitudinal axis of the spike section 48, and thus in substantially orthogonal relationship to the longitudinal axis of the housing 14.

With continued reference to FIGS. 3 and 6–10, the ground-engaging element 46 further comprises at least one ground-engagable wing section 60. The wing section 60 is a flat member which extends from the spike section 48 and extends in radial relationship to the longitudinal axis of the spike section 48. As shown in the Figures, the wing section 60, which preferably is formed from the same material as the spike section 48, is substantially triangular in profile, and tapers from its greatest width where it adjoins the second surface 58 of the pedal section 54, to its smallest width adjacent the second end 52 of the spike section 48.

As best shown in FIG. 2, at least one open-ended, unobstructed, longitudinal slot 62 is formed in the second end 18 of the housing 14. The slot 62 is sized to permit the wing section 60 of the ground-engaging element to extend therethrough when the spike section 48 is in a retracted position within the housing 14. The slot 62 thus functions to permit mechanical interengagement of the pedal section 54, disposed outside the housing 14, and the spike section 48, disposed inside the housing 14, via the wing section 60. The slot 62 also permits unobstructed vertical travel by the wing section 60, such as when the pedal section 54 is depressed.

As shown in FIGS. 3 and 6–10, the ground-engaging element 46 further comprises a guard assembly 64 supported on the ground engagement element 46, and preferably on the pedal section 54, for protectively separating the housing 14 from the pedal section 54. The guard assembly 64, which preferably is formed from the same material as the spike section 48, is a substantially planar member disposed in orthogonal relationship to the pedal section 54 and in clearing but adjacent relationship to the housing 14. In many instances, it will be preferred to form the spike section 48, pedal section 54, wing section 60 and guard assembly 64 as a single, integral construction.

Figure 4:
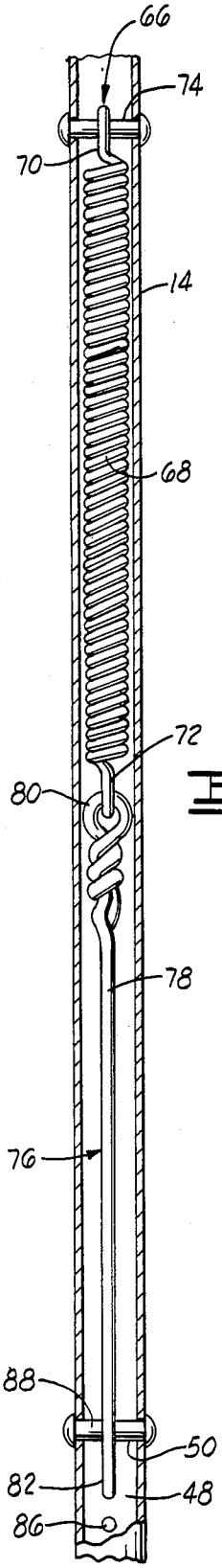
FIG. 4 is an enlarged partial cross-sectional view of the housing of the golf bag support of the present invention showing the biasing assembly and stop assembly.

With reference to FIG. 4, the golf bag support 10 of the present invention further comprises a biasing assembly 66, disposed intermediate the first end 16 of the housing 14 and the first end 50 of the spike section 48, for biasing the spike section 48 toward a normally retracted position within the housing 14. The biasing assembly 66 preferably comprises a coiled expansion spring 68, having a first end 70 and a second end 72, which is received within the housing 14. The spring 68 is anchored at its first end 70 to the housing 14 by way of a first cross member 74 which traverses the housing 14 intermediate its first end 16 and second end 18. A loop formed in the first end 70 of the spring 68 engages the first cross member 74 within the housing.

Figure 5:
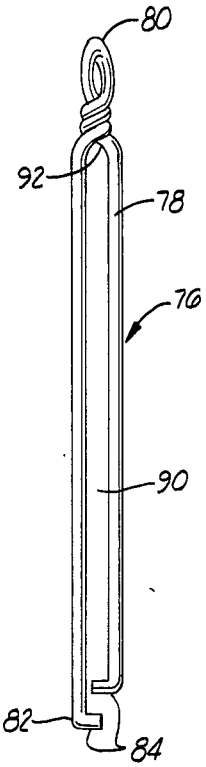
FIG. 5 is an enlarged side elevational view of the connecting arm of the biasing assembly shown in FIG. 4.
Figure 6:
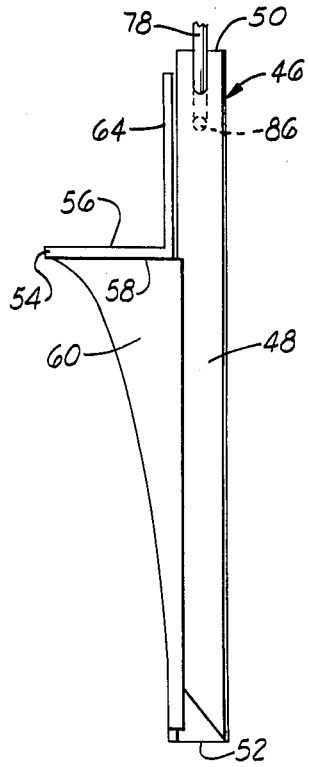
FIG. 6 is a side elevational view showing the ground-engaging element of the golf bag support of the present invention.

As shown in FIGS. 4 and 5, the biasing assembly 66 further comprises a connecting assembly 76 for interengaging the second end 72 of the spring 68 and the ground-engaging element 46. The connecting assembly 76 preferably comprises a connecting arm 78, formed from a material having high tensile strength, and is characterized by a first end 80 and second end 82. In the embodiment shown in FIG. 5, the connecting arm 78 comprises a framework formed from a single piece of wire; a loop is formed at the first end 80 of the framework and mechanically links with the second end 72 of the spring. Adjacent the second end 82, the connecting arm 78 is characterized by a pair of offset, inwardly bent lug elements 84. As shown in FIG. 6, these lug elements are received within a pair of offset parallel holes 86 penetrating the spike section 48. Channels 87 (see FIG. 8) are formed in the spike section 48 adjacent its first end 50 in order to permit clearance within the housing 14 of those portions of the connecting arm 78 adjacent the lug elements 84.

As shown in FIG. 4, a second cross member 88, preferably identical in construction to the first cross member 74, traverses the housing 14 and is attached therein at a position intermediate the second end 72 of the spring 68 and the first end 50 of the spike section 48.

The connecting arm 78 is characterized by an internal recess 90, shown in FIG. 5, through which the second cross member 88 is clearingly received. The internal recess 90 terminates a stop section 92 which obstructively engages the second cross member 88 as the spike section 48 is withdrawn from the housing. The engagement of the stop section 92 and second cross member 88 prevents further outward movement of the spike section 48 relative to the housing 14.

The second cross member 88 is positioned, and the internal recess 90 of the connecting arm 78 is sized, so that the second cross member 88 stops extension of the ground-engaging element 46, and sections thereof, when the pedal section 54 has been depressed to a position adjacent the second end 18 of the housing 14, as shown in FIG. 2. The second cross member 88 and the connecting arm 78 thus cooperatively function as a stop assembly for preventing depression of the pedal section 54 beyond the second end 18 of the housing 14.

The second cross member 88 is not limited to functioning as a stop assembly for the pedal section 54. In addition, the second cross member 88 obstructively engages the first end 50 of the spike section 48 as the spike section is withdrawn into the housing 14, and thus functions to define the retracted position of the spike section 48 within the housing 14.

With reference to FIGS. 1, 2 and 3, the golf bag support 10 is removably installed on the exterior of a golf bag 12 by resting the bottom of the golf bag 12 on the base plate 36, such that the outer periphery of the golf bag 12 fittingly engages the bracket 40. The retaining element 32 is loosened, and the hook assembly 24 is positioned so that its hooked upper portion 30 engages the upper rim 26 of the golf bag 12. After the hook assembly 24 has been positioned, the retaining element 32 is tightened. It will be noted that this attachment spacing feature permits a single golf bag support 10 to be used with golf bags of a variety of sizes.

After the hooked upper portion 30 has been engaged with the upper rim 26 of the golf bag 12, the lower portion of the golf bag 12 is encircled with the strap 42, the ends of which are tightly bound with the fastening device 44 in order to tightly grip the lower portion of the golf bag to the bracket 40 and thus the housing 14. Once this step has been completed, the housing 14 should closely adjoin the golf bag 12 and be oriented substantially parallel to the longitudinal axis of the golf bag 12, as shown in FIGS. 1 and 2. The open second end 18 of the housing 14 should be adjacent the bottom of the bag so that the second end 18 is oriented toward and immediately adjacent the ground when the golf bag is in an upright position, as shown in FIG. 2.

Once the golf bag support 10 has been installed as described, the golf bag 12 may be carried and used in the same manner as a conventional golf bag. If it is desired to remove the golf bag support 10 from the golf bag 12, the sequence of steps just described may be reversed.

If it is desired to support the golf bag 12 in an upright position, the user should position the bag on a suitable area of ground, such as a golf course, and manually holds it upright. The user should then depress the pedal section 54 with a foot, thereby driving the spike section 48 and wing section 60 into the ground, as shown in FIG. 2. The guard assembly 64 protects the housing 14 from dents or damage which the user's shoe could otherwise cause during the depression of the pedal section 54, as well as protect the shoe of the golfer from scrapping along the housing.

Once driven into the ground, the spike section 48 and wing section 60 function as an anchor for the housing 14, which in turn acts as a standard for the golf bag 12 and holds it upright until the bag is ready to be carried elsewhere. When the golf bag 12 is to be moved, it should be lifted by the user until the spike element 48 and wing element 60 are disengaged from the ground; if necessary, upward force may be applied with the user's foot to the pedal element 54 in order to assist this disengagement. Once the ground-engaging element 46 has been disengaged, the biasing assembly 66 functions to automaticaly withdraw the spike section 48 into its retracted position within the housing 14. Once the spike section 48 has become retracted, the bag may again be carried and handled like a conventional golf bag.

It should be noted that in the golf bag support 10 of the present invention, the ground is engaged, not only with the spike section 38, which projects from the housing 14, but also with a wing section 60 which extends outside the housing 14. The augmentation of the spike section 48 with the wing section 60 provides a larger surface area contact between the apparatus and the ground, and thus enhances the ability of the ground-engaging element 46 to remain fixed within the ground until removal is desired by the user. At the same time, the wing section 60 also contributes to the structural strength and stability of the pedal section 54.

Figure 11:
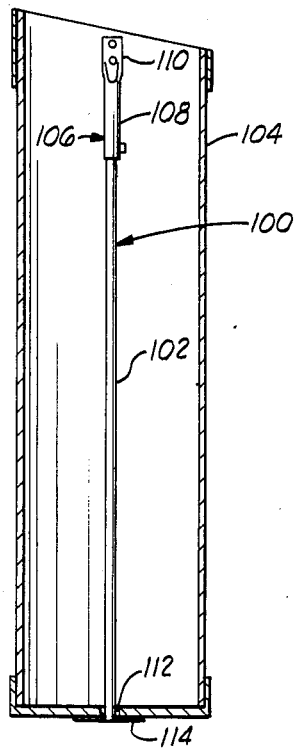
FIG. 11 is a cross-sectional view of another embodiment of the golf bag support of the present invention, in which the housing is installed in the interior of a golf bag.
Figure 12:
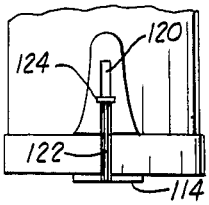
FIG. 12 is a partial elevational view of the lower portion of a golf bag in which the support of FIG. 11 has been installed, showing the pedal, wing and guard sections of the ground-engaging element.
Figure 13:
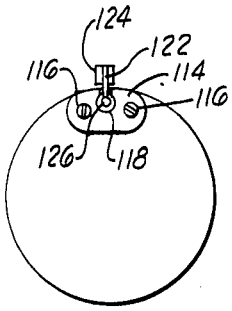
FIG. 13 is a bottom view of a golf bag in which the golf bag support of FIGS. 11 and 12 has been installed, showing the ground-engaging element and the base plate.

FIGS. 11, 12 and 13 show another embodiment of the golf bag support of the present invention, generally designated by reference numeral 100. A housing 102, identical in construction to the housing 14, is positioned within the interior of a golf bag 104. The upper attachment assembly 106, for securing the housing 102 adjacent its first end to the upper interior portion of the golf bag 104, comprises a lower portion 108 identical to the previously described lower portion 28. However, the upper portion 110 is not hooked, and instead comprises an attachment plate, integral with the lower portion 108. A ring (not shown), supporting the upper portion of the golf bag, may be used to interengage the attachment plate, via apertures (not shown) formed therein, and the upper portion of the golf bag. Alternatively, the housing 102 may be extended and flattened, rather than using a separate attachment assembly 106.

Figure 7:
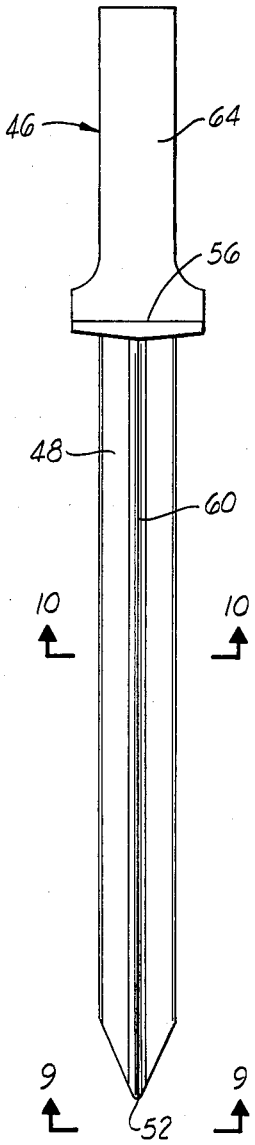
FIG. 7 is an enlarged elevational view of the ground-engaging element or spike removed from the remainder of the golf bag support.
Figure 8:
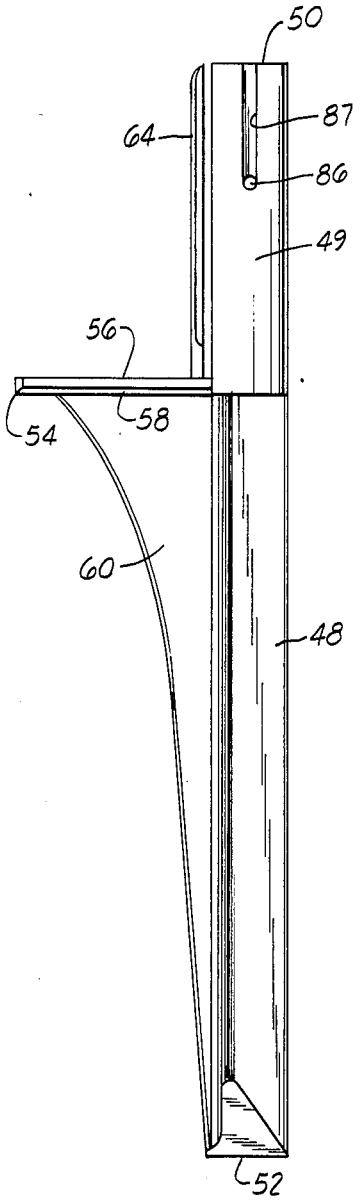
FIG. 8 is an elevational view of the spike taken at right angles to FIG. 7.
Figure 9:
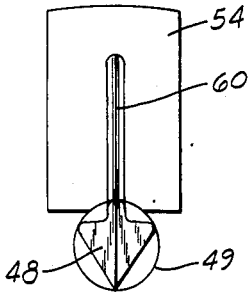
FIG. 9 is a bottom view of the spike as viewed per the lines 9—9 in FIG. 7.
Figure 10:
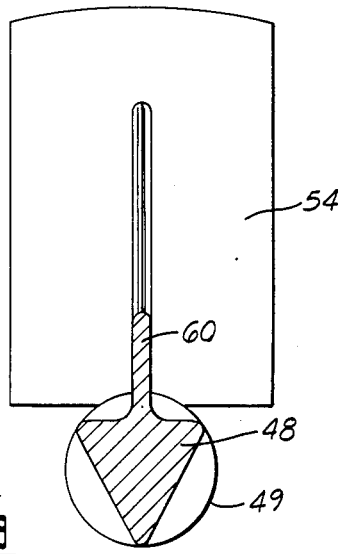
FIG. 10 is a cross sectional view of the spike as taken along lines 10—10 in FIG. 7.

The open second end of the housing 102 is received in an opening 112 formed in the bottom of the golf bag 104. As shown in FIGS. 7 and 9, a flat base plate 114 is secured to the bottom of the golf bag 104, adjacent a peripheral edge thereof, by connectors 116. Formed in the base plate 114 is an opening 118, which is positioned in underlying relationship to the opening 112 formed in the bottom of the golf bag. The housing 102 is secured at its open second end to the base plate 114, preferably by welding, in overlying relationship to the opening 118.

The golf bag support 100 further comprises a ground engagement assembly and biasing assembly identical to those previously described with reference to FIGS. 1–6. The golf bag 104 is provided with a longitudinal access slit 120 extending from the bottom of the bag in coextensive and communicating relationship to the open-ended longitudinal slot (not shown) formed in the housing 102 at its open second end. The housing 102 is oriented within the golf bag 104 so that the slot faces the access slit 120. The wing section 122 of the ground-engaging element projects through the adjoining slot and access slit 120 when the spike section 126 is in a retracted position, and the pedal section 124 is positioned on the exterior of the golf bag 104, near the bottom thereof, providing convenient access to a user of the device. When the pedal section 124 is depressed, the spike section 126 travels through the opening 118 in the base plate 114 and engages the ground. Other operational features of the golf bag support 100 are the same as those described previously with regard to the embodiment shown in FIGS. 1–6.

From the foregoing, it will be appreciated that the present invention offers a lightweight and easy-to-use golf bag support which can be adapted for use either as an internal or external golf bag accessory. In particular, the provision of a ground-engaging wing section in addition to a spike section enhances the ground-gripping capacity of the support of the present invention, while at the same time enhancing the structural stability of the pedal section of the device.

Changes may be made in the construction, operation and arrangement of the various parts, elements, steps and procedures described herein without departing from the spirit and scope of the invention as defined in the following claims.

What is claimed is:

1. Apparatus for supporting a golf bag on the ground, comprising:

a tubular housing having a first end and an open second end, the housing having at least one open-ended, unobstructed longitudinal slot formed therein communicating with said second end;

a ground-engaging element, comprising:

a spike section having a first end and a ground-engaging second end, the spike section movable between a retracted position within the housing and an extended position in which at least the second end of the spike section projects from the open end of the housing;

a pedal section, positioned outside the housing, having a depressable first surface and an opposed second surface; and a ground-engagable wing section means interengaging the spike section and the second surface of the pedal section, the wing section means extending through the slot in the housing when the spike section is in a retracted position; said wing section means being positioned to be pushed into the ground when the pedal section is fully depressed;

biasing means, disposed intermediate the first end of the housing and the first end of the spike section, for biasing the spike section toward a normally retracted position within the housing said biasing means comprising:

a coiled expansion spring positioned within the housing, the spring having a first end anchored at the housing, and a second end;

connecting means for interengaging the second end of the spring and the ground-engaging element; and stop means for preventing depression of the pedal section beyond the second end of the housing; said stop means comprising;

a cross member anchored to the housing and positioned to obstructively engage the connecting means when the pedal section is depressed to a position adjacent the second end of the housing;

attachment means for operatively securing the housing to a gold bag to be supported.

2. The apparatus of claim 1 in which the connecting means comprises a connecting arm having an internal recess in which the cross member may be clearingly received, the internal recess terminating at a stop section which may obstructively engage the cross member.

* * * * *

UNITED STATES PATENT AND TRADEMARK OFFICE

CERTIFICATE OF CORRECTION

PATENT NO. : 4,691,884

DATED : Sep. 8, 1987

INVENTOR(S) : A. Philip Parduhn

It is certified that error appears in the above-identified patent and that said Letters Patent is hereby corrected as shown below:

Col. 7, line 38, insert --second-- between the words "open" and "end".

Signed and Sealed this

Nineteenth Day of July, 1988

*Attest:*

*Attesting Officer*

DONALD J. QUIGG

*Commissioner of Patents and Trademarks*